US005429205A

United States Patent [19]

Collins

[11] Patent Number: 5,429,205

[45] Date of Patent: Jul. 4, 1995

[54] LADDER PLATFORM ACCESSORY

[76] Inventor: David Collins, 338 Richey Ave., Collingswood, N.J. 08107

[21] Appl. No.: 262,222

[22] Filed: Jun. 20, 1994

[51] Int. Cl.[6] ..... E06C 7/16

[52] U.S. Cl. ..... 182/122; 248/238

[58] Field of Search ..... 182/120–122, 182/129; 248/238

[56] References Cited

U.S. PATENT DOCUMENTS

| | | | |
|---|---|---|---|
| 407,079 | 7/1889 | Laskey | 182/121 |
| 1,216,214 | 2/1917 | Connell | 182/121 |
| 1,393,922 | 10/1921 | Taylor | 182/122 X |
| 3,511,338 | 5/1970 | Chapman | 182/121 |

FOREIGN PATENT DOCUMENTS

| | | | |
|---|---|---|---|
| 2348773 | of 9/1973 | Germany | 182/121 |
| 15538 | of 1900 | United Kingdom | 248/238 |
| 1179970 | 2/1970 | United Kingdom | 182/121 |

*Primary Examiner*—Alvin C. Chin-Shue
*Attorney, Agent, or Firm*—John Lezdey

[57] ABSTRACT

A ladder platform accessory is provided for standing or placing accessories. The accessory comprises a platform member which protrudes to the rear of the ladder and has a front portion which attaches to a lower rung. Brackets are detachably connected on the two opposite sides of the rear portion of the platform member which attaches to an upper rung. The platform member can be adjusted so as to be horizontal to the ground.

8 Claims, 2 Drawing Sheets

LADDER PLATFORM ACCESSORY

BACKGROUND OF THE INVENTION

1. Field of the Invention

The present invention relates to a platform accessory for use with ladders.

2. Description of the Prior Art

It has long been known to have platforms as appendages to conventional ladders to provide more standing area comfort to the user. Generally they comprise a flat deck mounted above a lower rung and suspended from the next higher adjacent rung. Various ladder-attached platforms (used to increase the standing area) disclosed in the prior art have poor stability characteristics. Many devices are mounted so that the platforms are not level when the angle of inclination of the ladder is changed, or such adjustment requires extra time and effort. Some prior art platforms are difficult to maneuver and move from one set of rungs to another. Further, some devices have such poor stability characteristics that the weight of the ladder user causes the platform to tilt, or to rock. This results not only in discomfort and fatigue to the user, but it is a potential for serious accidents.

U.S. Pat. No. 4,401,187 to Van Patten discloses a ladder platform for conventional ladders comprising a flat platform positioned on the lower rung of the ladder and connected to a higher portion of the ladder by a pair of resilient bracket arms which are inserted into the interior portions of the hollow rungs. In cases where the ladder does not have the necessary hollow rungs, holes must be drilled in the side rail to accommodate the resilient bracket arms. Another drawback with this patented device is that a tool or other instrument may accidently dislodge the resilient bracket arms.

U.S. Pat. No. 4,482,030 to Lincourt relates to a safety platform for a ladder comprising a platform, a pair of straps which are connected at opposite sides of the platform and have hook members which are suspended from an upper rung. The device includes a spreader to structurally strengthen the support platform. From a safety standpoint the patented support platform does not have securing means nor is it collapsible for easy storage and transport.

Therefore, there exists a need for a ladder platform accessory that is safe, stable, easy, to handle, can be collapsed into a compact form and readily adjustable to provide improved comfort to the user.

SUMMARY OF THE INVENTION

The present invention provides a ladder platform accessory which is stable, safe, portable and with platform leveling capability which eliminates the fatigue and discomfort normally associated with ladder use. The ladder platform accessory can also be used as a tool tray to hold tools, hardware, paint cans, and the like.

The ladder platform accessory comprises a platform member having a front end portion adapted to engage a lower rung of a ladder and protrude to the rear of the ladder;

bracket means detachably connected on two opposite sides of the rear portion of said platform member;

each of said bracket means comprising an upper bracket position having hook means adapted to engage an upper rung of said ladder and a lower bracket portion having means for adjusting said platform so as to be parallel to the plane of the ground.

Advantageously, there is provided a first securing means for detachably securing the hook means to an upper rung of the ladder; and a second securing means for detachably connecting the lower bracket portion to the platform and securing the platform member in essentially a horizontal plane.

In a further embodiment of the invention there is provided stabilizing means comprising stabilizing straps or arms adapted to engage the side rails of a ladder to enhance stability.

In another embodiment a support means comprising a stabilizing bar or metallic strip is connected at the top portion of the bracket means to stabilize the ladder platform accessory, to facilitate the handling of the assembly in moving from rung to rung and in securing the device.

An object of this invention is to provide an improved platform member for attachment between two adjacent rungs of a ladder with securing means and support means.

Yet another object of the invention is to provide a support for a worker on the ladder which permits easy access so as to move forward on the ladder without any obstruction.

Another object of this invention is to prevent any tilting or rocking of the platform accessory upon which the user may move with relative security.

Yet another object is to provide a ladder platform accessory which is collapsible into a very compact form which can be stored in a tool chest and easily transported.

BRIEF DESCRIPTION OF THE DRAWING

The invention is illustrated in the accompanying drawings in which like reference characters refer to the same parts throughout different views.

DETAILED DESCRIPTION OF THE PREFERRED EMBODIMENT

Figure 1:
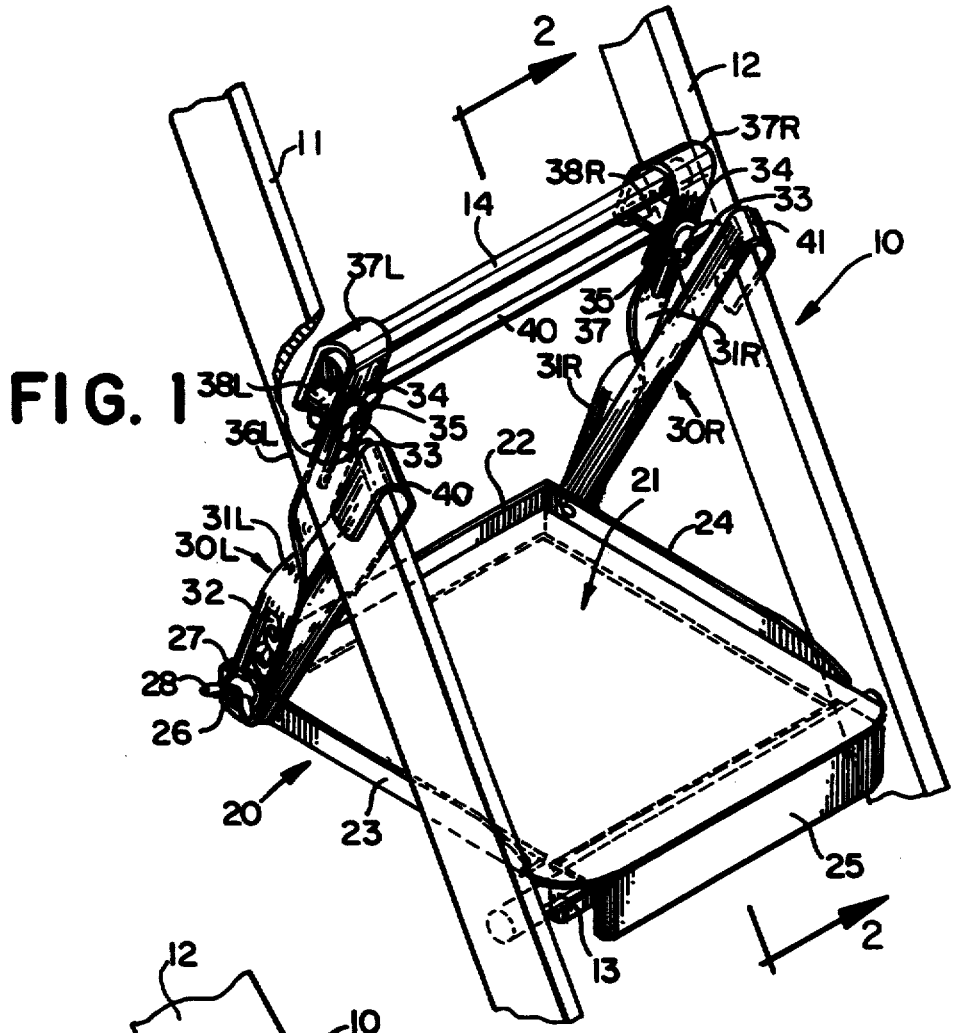
FIG. 1 is a perspective view showing the ladder platform accessory of the present invention including the support means connected to the top portion of the bracket means and the stabilizing straps or arms engaging the side rails of a conventional ladder.

Referring more particularly to the drawings a conventional ladder 10 having side rails 11 and 12 connected by a plurality of rungs represented by lower rung 13 and upper rung 14 is illustrated in FIG. 1. The ladder 10 is shown having round rungs. However, the ladder platforms accessory 20 can be adapted to be used with any conventional rungs, i.e., round, rectangular or flat top rungs.

The ladder platform accessory 20 of this invention comprises a platform member 21 having a back raised edge 22 and raised parallel side edges 23 and 24. A U-shaped member 25 comprising a rung adapter is attached directly below the front edge and extends transversely across the platform member 21 to be adapted to engage the lower rung 13 of the ladder. The rung adapter 25 may be attached by welding or by nuts and bolts. It is preferred that the top surface of the platform member 21 has roughen or abrasive surface to prevent slipping.

Figure 2:
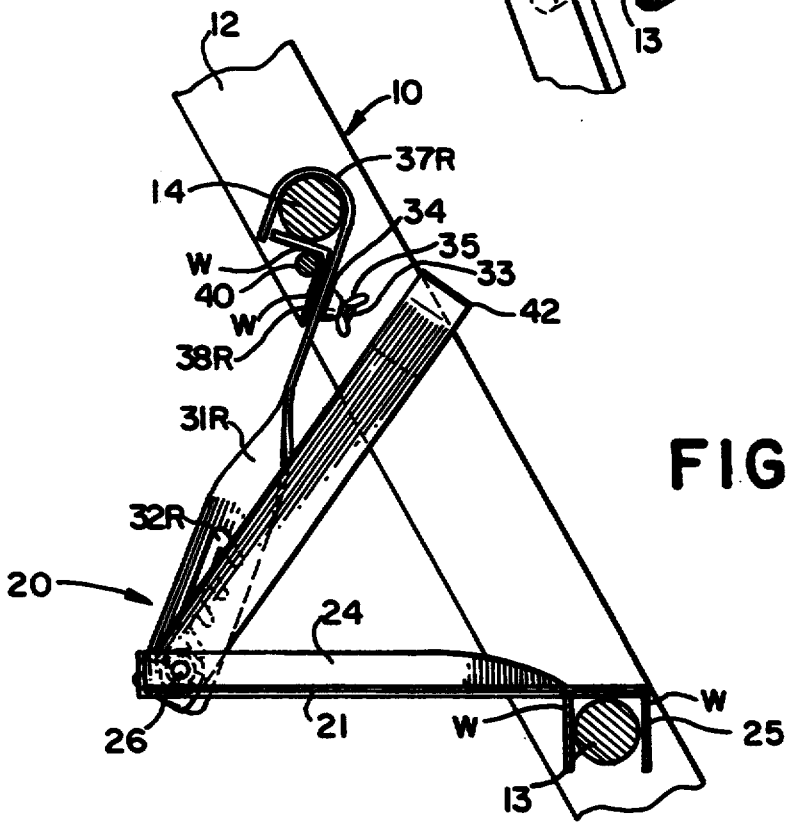
FIG. 2 is an elevational side view of the invention illustrating the ladder platform accessory of the present invention as shown in FIG. 1.

As seen in FIGS. 1 and 2 the ladder platform accessory 20 further comprises left and right bracket means 30L and 30R. Each bracket means comprises an upper bracket portion 36L,36R and a lower bracket portion 31L,31R. Each upper bracket portion 36L and 36R comprises a hook means 37L and 37R and a securing means which comprise L-shaped members 38L and 38R which are slidably adjustable in slot 39L and 39R and detachably secured by bolt 33, washer 34, and wing nut 35. The lower bracket portion of the bracket means comprises adjusting means having a plurality of notched openings 32. Stabilizing arms or straps 41 and 42, which are adapted to wrap around the side rails 11 and 12, have an upper portion having hook means with the hook terminus directed towards the outside edges of the ladder side rails 11 and 12. The lower portion of the stabilizing straps 41 and 42 are generally positioned between the bracket means and platform 21, and are detachably secured along with bracket means by bolt 26, washer 27, and wing nut 28.

Figure 3:
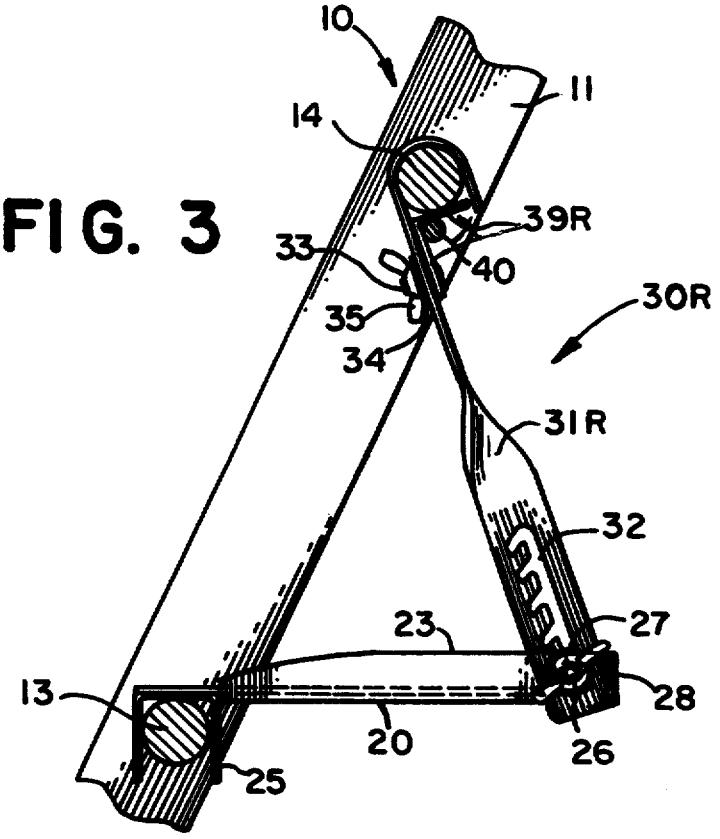
FIG. 3 is a side elevational view of the ladder platform accessory without the stabilization straps and the support means.
Figure 4:
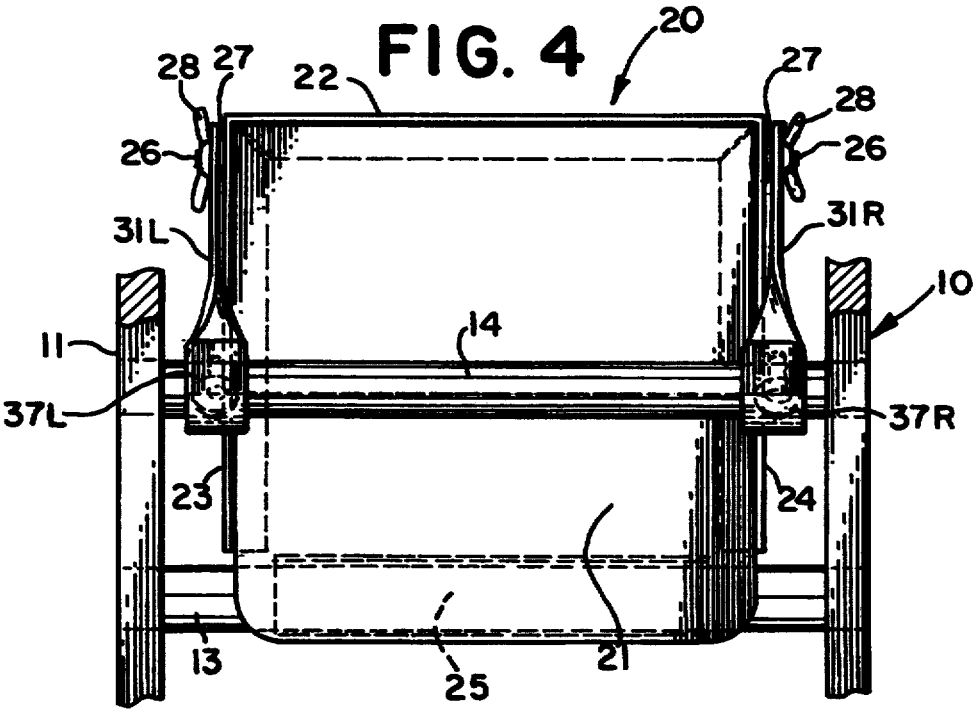
FIG. 4 is a top view of the invention without the stabilization straps and support means.

In a preferred embodiment the L-shaped securing members 38L and 38R are connected to each other by support means 40 which serves structurally to strengthen the accessory 20 and acts as a locating or guiding member which facilitates placing the platform on the ladder rungs. As shown in FIGS. 2 and 3, bar 40 may be secured to the members 38L and 38R by welding. The weld locations are designated by the letter "W". In the alternative, the support means 40 may affixed thereto by nuts and bolts material, or a combination of conventional materials. For example, the platform 21 may be made of plywood and the other components of aluminum or steel. It is preferred to have all components be metallic, and most preferably manufactured of aluminum.

In use, the platform 21 of the accessory 20 is placed over lower rung 13 and the U-shaped member 25 is positioned to engage lower rung 13. Hook means 36L and 36R are engaged on upper rung 14 and stabilizing steps 41 and 42 are hooked onto side rails 11 and 12. Next, the bar 40 attached to L-shaped securing members 38L and 38R are secured with the left and right bolt 33—washer 34—wing nut 35 combinations. The final adjustment involves providing, essentially, a horizontal plane of the platform 21 which depends on the angle of the inclination to the vertical. This adjustment is made and secured by tightening nut 26—washer 27—wing nut 28 combinations on each side of platform 21.

As can be readily appreciated variations in the operation are within the scope of one skilled in the art. For example, the hooking means 36L and 36R may be initially attached, followed by connecting the stabilizing straps and finally platform 21 is attached, adjusted, and secured in the manner described.

It is in this respect, as described above, together with the collapsibility of the device, that the present invention constitutes as improvement over previous devices for this purpose.

What is claimed:

1. A ladder platform accessory comprising:

a platform member having a front end portion adapted to engage a lower rung of a ladder and protrude to the rear of the ladder;

bracket means detachably connected on two opposite sides of the rear portion of said platform member;

each of said bracket means comprising an upper bracket portion having a hook means adapted to engage an upper rung of said ladder and a lower bracket portion having regulating means for adjusting said platform member so as to be parallel to the plane of the ground;

a first securing means for detachably securing said hook means to an upper rung of said ladder;

a second securing means for detachably connecting said lower bracket portion to said platform and securing said platform member in essentially a horizontal plane;

said first securing means having two L-shaped metallic members secured and affixed with nuts and bolts inwardly behind each said upper bracket portion to contact the underside of said upper rung; and a support means including a metallic bar for connecting together said L-shaped metallic members.

2. The ladder platform accessory of claim 1 wherein said upper bracket portion includes a vertical slot which serves to hold said first securing means.

3. The ladder platform accessory of claim 1 wherein said platform member has an abrasive surface.

4. The ladder platform accessory of claim 1 wherein said platform member has raised edges.

5. The ladder platform accessory of claim 4 wherein said platform member has raised edges on all sides except for the front edge.

6. The ladder platform accessory of claim 1 including stabilizing means comprising an upper stabilizing portion having hook means to engage said side rails and a lower stabilizing portion detachably connected to said platform member.

7. The ladder platform accessory of claim 6 wherein said upper stabilizing portion further comprises metallic straps having hook means on the outside rail of said ladder.

8. The ladder platform accessory of claim 1 wherein the front end portion comprises a U-shaped bracket which engages the lower rung.

* * * * *